US007118244B2

(12) United States Patent
Kurtz

(10) Patent No.: US 7,118,244 B2
(45) Date of Patent: Oct. 10, 2006

(54) EMERGENCY LIGHT

(76) Inventor: John D. Kurtz, One University Pl., #22A, New York, NY (US) 10003

( * ) Notice: Subject to any disclaimer, the term of this patent is extended or adjusted under 35 U.S.C. 154(b) by 0 days.

(21) Appl. No.: 10/795,069

(22) Filed: Mar. 5, 2004

(65) Prior Publication Data

US 2005/0195594 A1 Sep. 8, 2005

(51) Int. Cl.
*F21L 4/02* (2006.01)
*F21V 33/00* (2006.01)

(52) U.S. Cl. ..... 362/184; 362/227; 362/271; 362/335; 362/362; 362/370

(58) Field of Classification Search ..... 362/184, 362/227, 235, 271, 276, 335, 362, 370, 800
See application file for complete search history.

(56) References Cited

U.S. PATENT DOCUMENTS 5,768,814 A * 6/1998 Kozek et al. ..... 40/570
5,947,208 A * 9/1999 Ha ..... 169/51
6,010,228 A * 1/2000 Blackman et al. ..... 362/95
6,388,695 B1 * 5/2002 Nagumo ..... 347/237
6,735,379 B1 * 5/2004 Salmon et al. ..... 392/418
2004/0046678 A1 * 3/2004 Grady, Jr. ..... 340/908
2004/0233681 A1 * 11/2004 Yao et al. ..... 362/565
2005/0047130 A1 * 3/2005 Waters ..... 362/231

OTHER PUBLICATIONS

Power Light Source Luxeon TM Star Technical Datasheet DS23.
Kodak Alkaline Battery Product Specification Sheet.

* cited by examiner

*Primary Examiner*—John Anthony Ward
*Assistant Examiner*—Mark Tsidulko
(74) *Attorney, Agent, or Firm*—Stroock & Stroock & Lavan LLP

(57) ABSTRACT

An emergency light source comprising a housing and an energizing circuit selectively operatively coupling LEDs to a battery power source is provided for lighting a selected area to provide at least twenty-four hours of continuous light when energized. The emergency light source is activated by an activator having at least one of a manual activator and at least one light detector detecting a predetermined reduction in ambient light, wherein the activator is operatively coupled to the energizing circuit and causes the energizing circuit to operatively couple the battery power source and the LEDs.

22 Claims, 12 Drawing Sheets

1
52
20
10
61
62
56
21
22
55

EMERGENCY LIGHT

BACKGROUND OF THE INVENTION

The present invention relates generally to emergency light sources, and, in particular, to emergency light sources suitable for illuminating areas such as hallways, stairways, elevator banks, and the like. In particular, the present invention is directed to a battery-operated emergency light source suitable for extended use during a power outage.

An area such as a hallway or a stairway may be illuminated during a power outage by a conventional emergency lighting system which generally consists of a light that is powered by a rechargeable battery. The rechargeable battery is usually connected to an electrical source via an electrical circuit and is charged conventionally continuously. When the power source fails, the system uses the stored energy to power the light. These emergency lighting systems, however, are meant to be brilliantly lit for a very limited period of time, for instance, during a brief power outage, and therefore do not last more than several hours, on the average. Once the power is restored, the rechargeable batteries can be charged again in preparation for the next power outage. In the event of an extended power outage, however, the rechargeable batteries become spent after a few hours, leaving the lights without power and unusable until the power returns. Once these rechargeable batteries are spent, light is no longer available, and the areas lit only by these lights become completely dark, creating dangerous conditions.

Most light bulbs, such as incandescent light bulbs used in conventional emergency light sources, are lit by heating filaments. These filaments burn out and dissipate heat and therefore waste energy. Once the filament burns out, the light bulb cannot be used, resulting in a short life of the bulb.

Additionally, rechargeable batteries typically used to power emergency lights do not have a long shelf life. They are self discharging and will become useless after about six months if it is not recharged during that time. Therefore, the rechargeable batteries require strict maintenance and must be charged on a regular basis. An alternative for rechargeable batteries is a building generator, which is big, expensive and requires an emergency fuel source which itself raises safety and storage problems. In fact, because of the expense of conventional emergency power systems, including the cost of providing an electrical source in the vicinity of the system, many existing buildings have no such systems, especially private houses and buildings built before codes required emergency lighting.

Accordingly, there is a need for an emergency light source that can be easily mounted on a fixture, ceiling, wall, and the like, can be battery operated and provide continuous light for more than 24 hours.

SUMMARY OF THE INVENTION

Generally speaking, in accordance with the invention, an emergency light source is provided which includes a housing, at least one LED carried by the housing and performing an emergency lighting function in a selected area when energized, a battery power source carried by the housing selected to energize the at least one LED to provide at least twenty-four hours of continuous light, an energizing circuit carried by the housing selectively operatively coupling the at least one LED with the battery power source to energize the at least one LED, an activator carried by the housing and having at least one of a manual activator and at least one light detector detecting a predetermined reduction in ambient light, the activator being operatively coupled to the energizing circuit to cause the energizing circuit to operatively couple the battery power source and the at least one LED.

The objects and features of the present invention will become apparent from the following detailed description, considered in conjunction with the accompanying drawing figures. It is to be understood, however, that the drawings are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative.

DETAILED DESCRIPTION OF THE PRESENTLY PREFERRED EMBODIMENTS

Figure 1:
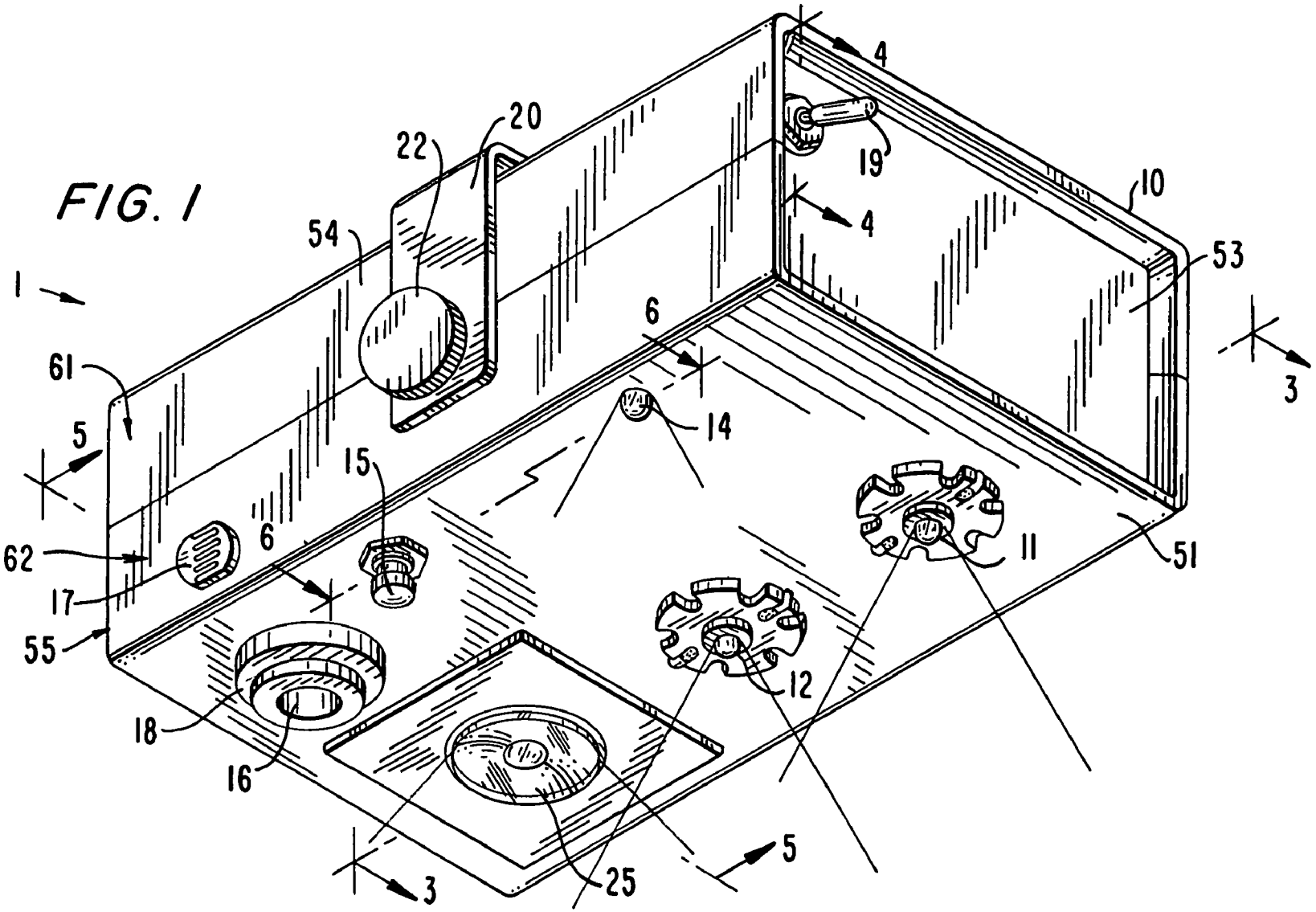
FIG. 1 is a perspective view of an embodiment of a light source constructed in accordance with an embodiment of the invention.
Figure 2:
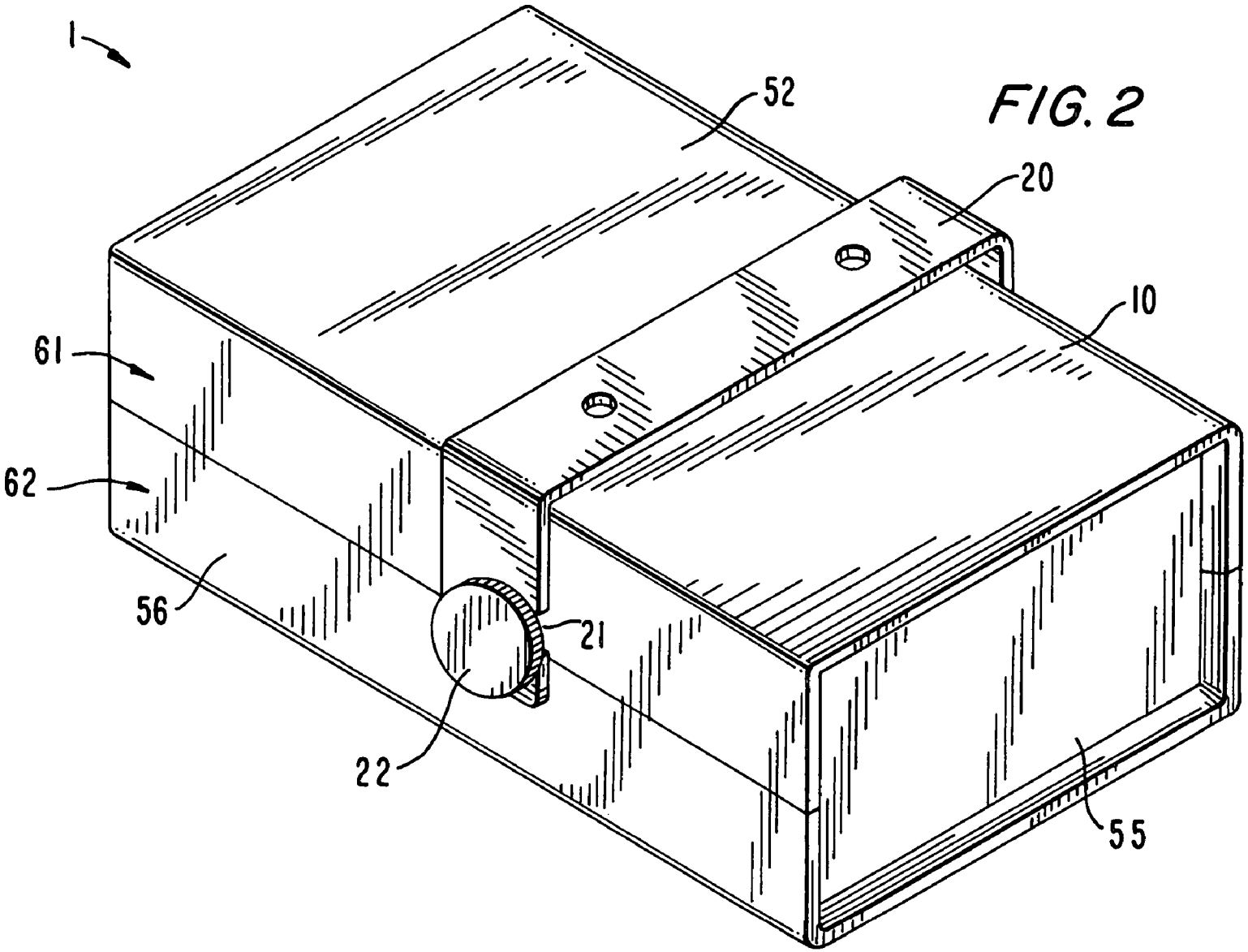
FIG. 2 is a reverse perspective view of the light source of FIG. 1.
Figures 3, 4:
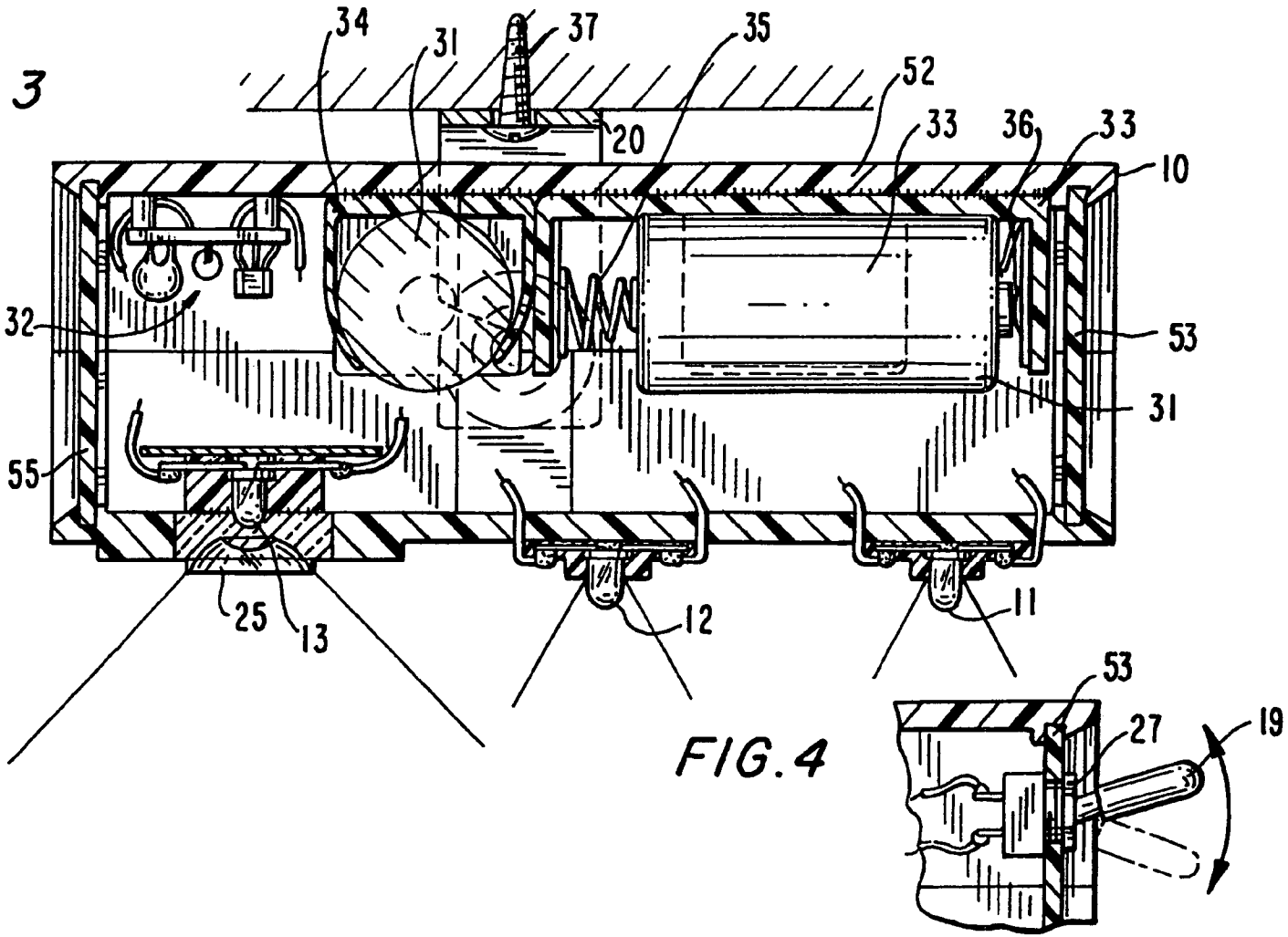
FIG. 3 is a cross-sectional view of the light source of FIG. 1 taken along section line 3—3 of FIG. 1.
FIG. 4 is a cross-sectional view of a part of the light source of FIG. 1 taken along section line 4—4 of FIG. 1.

The invention is directed to an emergency light source, and, in particular, to a battery operated emergency light source for use in dark areas, which preferably provides the user with light sufficient to safely traverse such areas or to provide limited functions in such areas, over an extended period of at least 24 hours. In its preferred embodiment of the invention an emergency light source is provided having a circuit that draws substantially the same amount of power from the battery power source as the amount of power necessary to light at least one LED light source when in use.

The invention can be used in a variety of places, such as hallways or elevator banks but is not limited to enclosed areas. The invention can be mounted on a fixture or directly to a wall or a ceiling. Alternatively, the invention can be a portable device. A preferred embodiment of the invention is mountable on the ceiling or wall of an enclosed area, such as a hallway, a stairway, or an elevator car. It is preferable for the invention to be mountable on the ceiling or a high wall, which facilitates positioning. This embodiment of the invention can therefore be installed anywhere indoors where there is a wall, a ceiling, or a beam. However, it is understood that the invention can also be placed on the floor or an elevated surface without the need for a mount, as a matter of application specific to design choice.

Light Emitting Diodes (LEDs) are known in the art and are used in a variety of ways, including flashlights and traffic lights. LEDs are advantageous over ordinary incandescent light bulbs because LEDs do not have a filament that burns out and wastes energy. Instead, LEDs are illuminated solely by the movement of electrons in a semiconductor material, not by heating a filament. Therefore, LEDs last longer, dissipate minimal heat and reduce wasted energy. An LED requires less energy to obtain the same intensity of light as a bulb. Additionally, LEDs in general are rated at about 100,000 hours of use. Therefore, there is no need to replace the LED after a nominal use.

The invention provides an emergency light source having one or more LEDs, more preferably white LEDs, are connected to a portable power source, preferably one or more—alkaline batteries. In a preferred embodiment, the LEDs are rated at about 23 lumen output at a current of about 350 mA and a typical voltage of about 3.42 V.

In the embodiment of the invention as depicted in FIGS. 1–9, emergency light source 1 is powered by three Alkaline C batteries 31, which provide a total voltage of about 4.5V. Emergency light source 1 preferably includes a circuit designed to draw a small amount of energy from the power source defined by batteries 31 substantially equal to the energy necessary to activate LEDs 11, 12, 13, thereby maximizing the utility of the batteries. The embodiment of the invention using three alkaline C batteries can provide over 48 hours of continuous use, more preferably about 54 to 62 hours, which is substantially longer than the lifetime of any conventional battery-operated emergency light source. However, the invention is not limited to any particular number or type of batteries, provided sufficient power over a sufficient period of time to cause the LEDs to emit a sufficient amount of light to perform an emergency lighting function for a desired period of time is provided. The emergency lighting function is defined as sufficient light to permit safe passage through the area being lit and the performance of required minimal functions such as the operation of doors, locks and elevators. It is not intended to provide sufficient light to totally replace the normal lighting.

In a preferred embodiment, emergency light source 1, when in use, initially draws about 122 milliamps (mA). Over time, the power drawn gradually decreases resulting in the decreasing of the intensity of illumination of LEDs 11, 12, 13. After about 48 hours of continuous use, the preferred embodiment of the invention will preferably emit a light at a lower but viable level, drawing about 68 mA. The invention can then continue emitting light at the lower intensity, also gradually growing dimmer but sufficient to provide desirable illumination in the area for about an additional 6 to 14 hours.

In one embodiment, LEDs 11, 12 and 13 are LUXEON™ Star or Star/O, manufactured by LUMILEDS LIGHTING, LLC. The LUXEON™ Star preferably is a Batwing or Lambertian, both of which are models of the LUXEON™ Star. The LUXEON™ Star Batwing more preferably is model number LXHL-MWEC, most preferably LXHL-MWEC-QWJW, and the LUXEON™ Star Lambertian more preferably is model number LXHL-MW1D, most preferably LXHL-MW1D-PWOJW. The LUXEON™ Star/O preferably is a Batwing, more preferably model number LXHL-NW98, most preferably LXHL-NW98-P4JW.

Referring to FIGS. 1 to 7, the preferred embodiment of the invention further includes a housing 10 enclosing batteries 31, and circuit board 32. Housing 10 is generally a rectangular box having an upper portion 61 and a lower portion 62 preferably releasably held together by a plurality of screws or bolts (not shown) to permit battery replacement. Housing 10 preferably has bottom wall 51, and a top wall 52 and four side walls 53, 54, 55, 56. LEDs 11, 12, 13 are, in this embodiment, positioned in a linear arrangement on bottom side 51 of lower portion 62, but any of other positioning, as appropriate for the siting of the emergency light source, may be used. Other housing shapes and configurations may be used in accordance with the invention.

The invention can take various forms and provide various lighting options. For example, FIGS. 1 to 7 show an embodiment of the invention including three LEDs consisting of two LEDs 11, 12 positioned to provide distributed light and one LED 13 positioned to provide a beam of light. LEDs 11, 12 preferably emit light at a view angle ranging from 110–140° and provide light that is not focused, thereby providing diffused light to illuminate the vicinity of the invention. For example, the diffused light may be desirable to light an entrance or an elevator bank. To this end, LEDs 11, 12 are mounted on the outer surface of bottom wall 51.

LED 13, on the other hand, provides a focused, directed, and more intense light. LED 13 preferably is aligned with a collimating optic lens 25 which generates a view angle of about 10°. LED 13 is mounted inside of bottom wall 51 below lens 25, which is mounted in bottom wall 51. The beam produced by LED 13 and lens 25 can provide a more intense light at a certain spot or it can be used to light an area extending away from the invention, such as a hallway or a staircase, where more than one spot needs to be illuminated. The presence of the beam generated by LED 13 and lens 25 can help eliminate dark spots of no light in the areas in between different light sources.

By providing an emergency light source including both distributed and beam light, one device can suffice to light a section of a hallway, or a stairwell. For example, LEDs 11, 12 can provide light at the entrance of the stairwell whereas the beam produced by LED 13 and lens 25 can be directed to shine up or down the stairs. Most emergency lights only provide light at certain spots, leaving many areas completely dark. By providing a light source that includes LEDs capable of producing both distributed and beam light, the target areas can be lit as well as other areas nearby such as the connecting hallways or stairs. Whereas FIGS. 1 to 7 show light source 1 having two distributed light sources and one beam light source, it is understood that the number of each type of light source can be altered without deviating from the scope of the invention.

The embodiment of FIGS. 1–9 further comprises a low battery alert LED 14, a testing button 15, light sensors 16, 17, shield member 18 for light sensor 16 to prevent light sensor 16 from detecting light from LEDs 11, 12, 13, a switch 19 to turn the invention on and off, and mounting bracket 20. Light sensor 16 is positioned adjacent to LED 13 on bottom wall 51, perpendicular to the alignment of LEDs 11, 12, 13. Testing button 15 is preferably secured by a washer 26 to bottom wall 51. Light sensor 16, and low battery alert LED 14 are also positioned on bottom wall 51. Light sensor 17 is located on side wall 54, thereby detecting light that might not be detected by light sensor 16 because of the angle at which it is emitted. On/off switch 19 is located on side wall 53 and held in place by washer 27. On/off switch 19 can be positioned in series with the battery power source (e.g., batteries 31) to turn the emergency light source on when placed in use, while preventing drain of the batteries after manufacture but before use.

Figure 7:
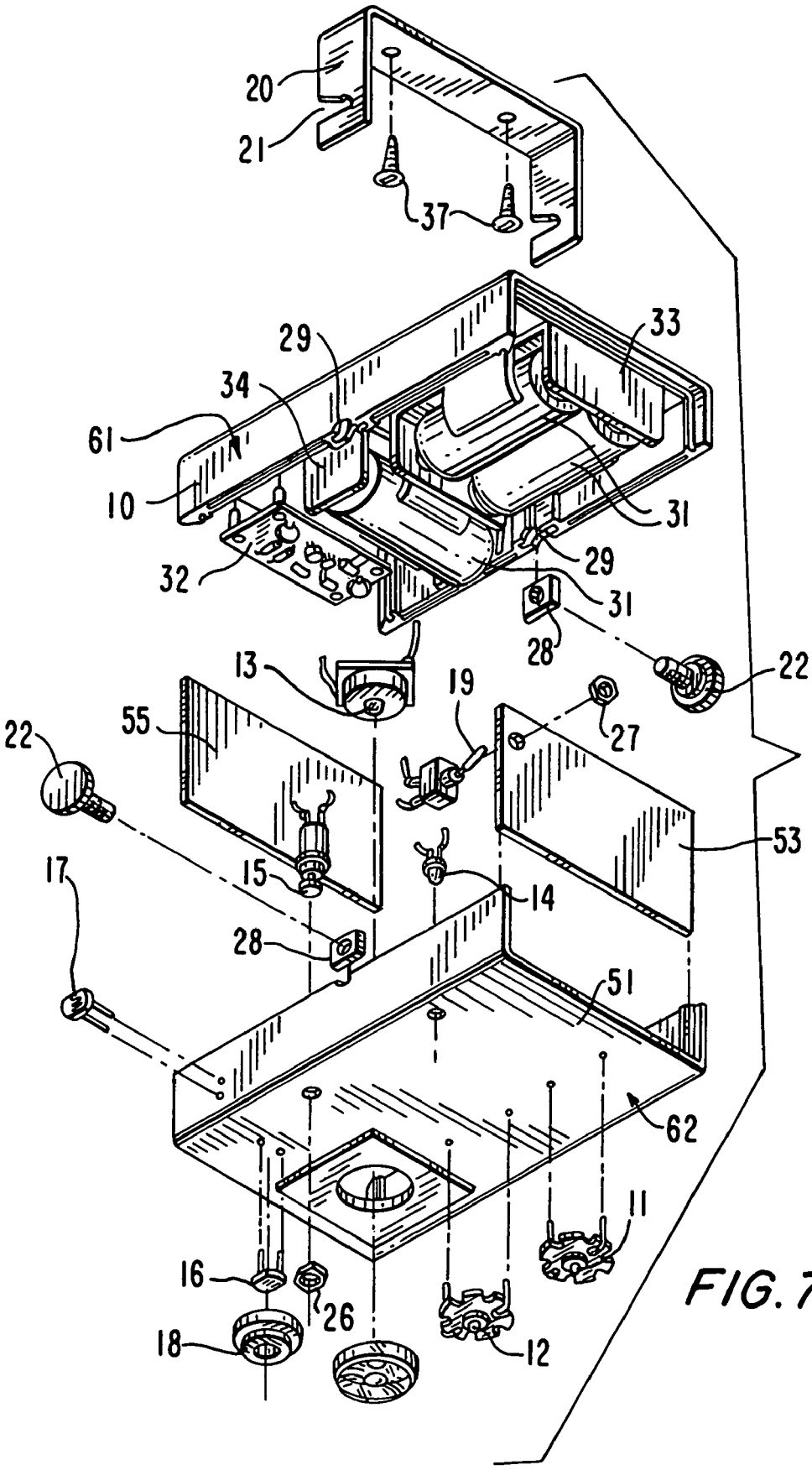
FIG. 7 is an exploded view of the light source of FIG. 1.

As shown in FIG. 7, three batteries 31 are located proximate each other, wherein two are adjacent to each other and one is positioned perpendicular to the other two. Holders 33, 34 help retain batteries 31 in place and support contacts (e.g., 35, 36 of FIG. 5) which help electrically couple batteries 31 to circuit board 32 mounted on top wall 52. Suitable wiring (not shown) electrically couples contacts 35, 36 and therefore batteries 31 to circuit board 32 and also electrically couples LEDs 11, 12, 13, light sensors 16, 17, low battery alert LED 14, testing button 15 and on/off switch 19 to circuit board 32.

Figure 5:
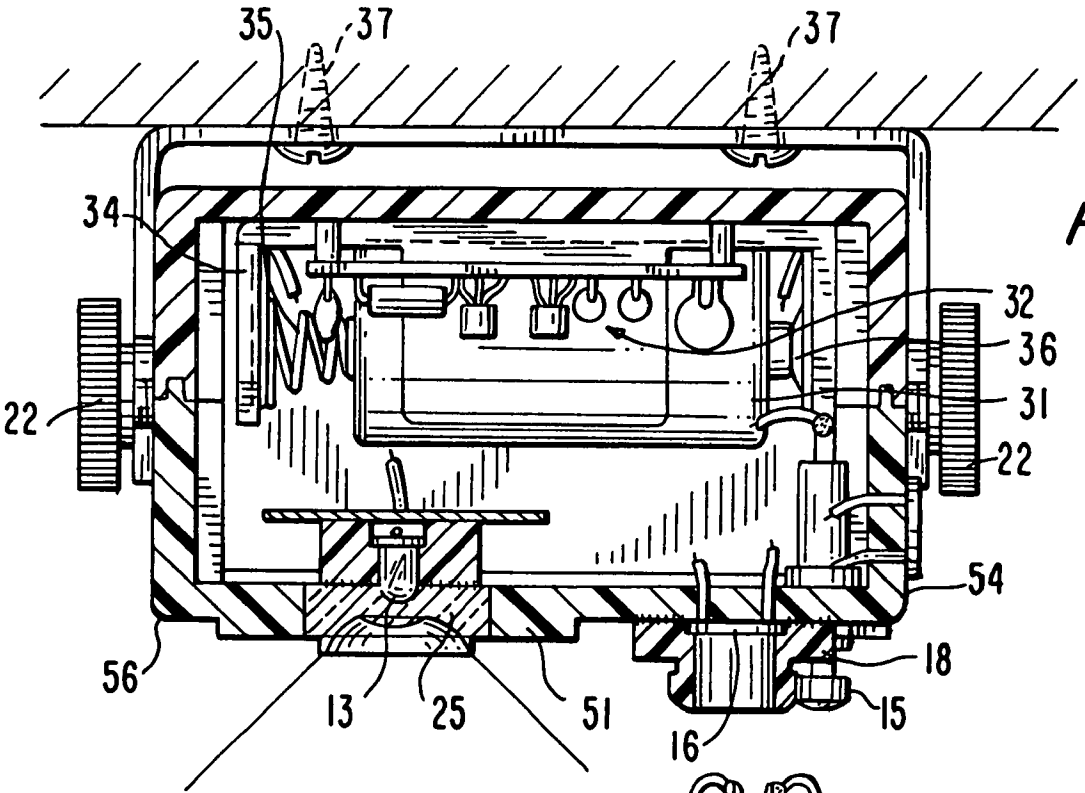
FIG. 5 is a cross-sectional view of the light source of FIG. 1 taken along section line 5—5 of FIG. 1.
Figure 6:
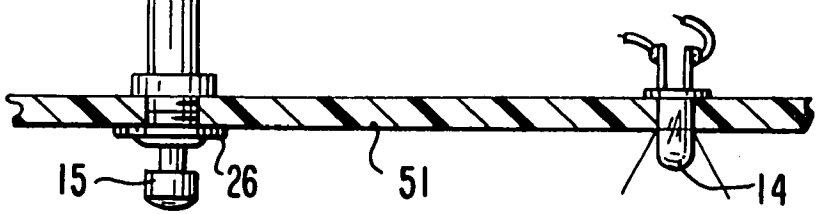
FIG. 6 is a cross-sectional view of a part of the light source of FIG. 1 taken along section line 6—6 of FIG. 1.

Mounting bracket 20 permits the emergency light source to be mounted practically anywhere, such as on a ceiling or wall, and in many orientations. Preferably mounting bracket 20 is attachable to a fixture, ceiling, wall, and the like, by two screws 37, as shown in FIGS. 5 and 7. Mounting bracket 20 is preferably releasably connected to housing 10 via knobs 22, which are screwed into nuts 28 captured in slots 29 in side walls 54, 56 of housing 10. Mounting bracket 20 preferably includes slots 21 through which knobs 22 can be inserted held in place by tightening knobs 22 and thereafter removed by loosening knobs 22. Therefore, housing 10 is relatively easily detachable from mounting bracket 20 without the need for tools.

A testing mechanism comprising testing button 15 permits the testing of LEDs 11, 12, 13. When switch 19 is in the "on" position, one can press testing button 15 and light LEDs 11, 12, 13, which permits LEDs 11, 12, 13 to be checked for intensity.

Referring to FIG. 1, it is preferable to have two light sensors 16, 17 to activate the invention and light the LEDs 11, 12, 13 when the surrounding area is sufficiently dark. By providing one light sensor 16 on the same plane of housing 10 as LEDs 11, 12, 13 and one light sensor 17 at ninety degrees, it helps to ensure that the light is not turned on if there is sufficient light in the vicinity. More light sensors may be used, for example, on housing 10 at ninety degrees to light sensors 16, 17 or on the opposite side of housing 10 from light sensor 17. Alternatively, only one light sensor can be used, as a matter of application specific to design choice. Whereas shield member 18 for light sensor 16 is shown as a protrusion from housing 10, it is to be understood that other embodiments of shield members can be used or none at all. For example, light sensor 16 can be placed below the surface of housing 10, thereby eliminating the likelihood of light sensor 16 detecting light from ambients 11, 12 or beam 13.

In a preferred embodiment of the invention, the invention preferably includes an activator circuit having two CdS light activated variable resistors serving as light sensors 16, 17. When the light sensors 16 and 17 detect that there is not a sufficient amount of ambient light in the proximity of emergency light source 1, the emergency light source is activated and the LEDs 11, 12, 13 are lit, thereby illuminating the target area. It is understood, however, that the light sensors may be of other forms capable of detecting the level of ambient light, preferably of a type that draws very low current, like CdS light activated variable resistors. Further, a sensor is not required and the invention may comprise a circuit without the CdS light activated variable resistors, light sensors, but rather just on/off switch 19 may be used to light the LEDs 11, 12, 13. Alternatively, on/off switch 19 or a separate on/off switch may be used in conjunction with light sensors 16, 17, in which the on/off switch, in its "on" position, overrides light sensors 16, 17.

Figure 8:
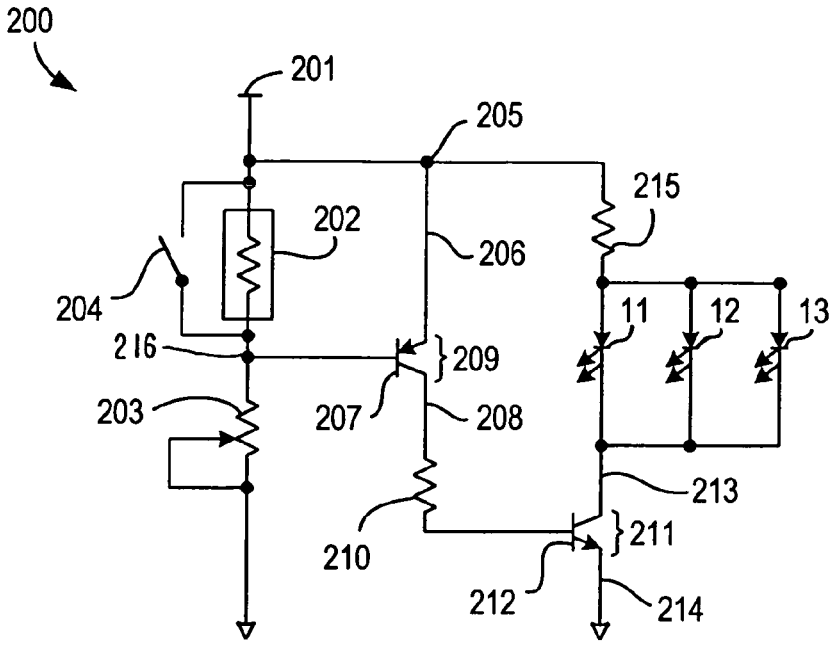
FIG. 8, is a circuit diagram of a circuit suitable for controlling the illumination of LEDs in accordance with an embodiment of the invention.

Referring to FIG. 8, an embodiment of an energizing circuit 200 driving LEDs 11, 12, 13 comprises a power terminal 201 which is connected to batteries 31. One or more light sensors in the form of CdS light activated variable resistors 202 are connected between power terminal 201 and a variable resistor 203 which in turn is connected to ground. Variable resistor 203 permits setting up the sensitivity of the circuit, i.e., the level of ambient light at which the LEDs are activated. Power terminal 201 is connected at a point 205 to the emitter 206 of an PNP transistor 209. If base 207 of PNP transistor 209 is biased positive by the voltage at point 216, PNP transistor 209 prevents the passage of current, whereas current may pass if base 207 of PNP transistor 209 is biased negative by the voltage at point 216, which in turn depends on whether or not light sensors 202 detect a predetermined level of ambient light deemed insufficient as to require emergency lighting. The voltage caused by current passing through the emitter/collector path of PNP transistor 209 is applied through resistor 210 to the base 212 of a NPN transistor 211. NPN transistor 211 amplifies the current received in order to activate LEDs 11, 12, 13. NPN transistor 211 functions in an opposite manner from PNP transistor 209. For example, if base 212 of NPN transistor 211 coupled through resistor 210 to the emitter-collector path of PNP transistor 209 is biased negative, NPN transistor 211 prevents the passage of current, whereas current may pass if base 211 is biased positive. The emitter 214 of NPN transistor 211 is grounded whereas the collector 213 is connected to LEDs 11, 12, 13. LEDs 11, 12, 13 are connected in parallel between the collector 213 of NPN transistor 211 and resistor 215, which is connected to power terminal 201 through point 205. Switch 204, which can short current light sensors 202, can be a momentary switch to permit testing of the operation of the emergency light source or a regular on/off switch to turn the energizing light source on without regard to the level of ambient light.

Energizing circuit 200 is preferably biased to draw about 20 to 25 μA, more preferably about 21 μA, in standby. Since the shelf life of an alkaline C battery is about five years, the total power drawn during standby would not significantly decrease the life of the battery.

Referring to FIGS. 1 and 7, an embodiment of the invention includes a low battery alerting mechanism. The alerting mechanism preferably comprises of at least one alert LED 14 that flashes, alerting the viewer either that the battery must be replaced, when in standby mode, or that the LEDs will only remain lit for a certain amount of time, while the LEDs are lit.

Because the shelf life of an alkaline battery is so long, it is foreseeable that the person maintaining an emergency light source in accordance with the invention will forget when the battery must be replaced when the device is in standby mode. An alerting mechanism can provide visual alerts and make testing the battery unnecessary, thereby simplifying maintenance. This is especially beneficial if the invention is mounted out of easy reach, since the emergency light source does not need to be removed from the mount in order to test the batteries. Therefore maintenance of the invention is rendered relatively simple.

Figure 9:
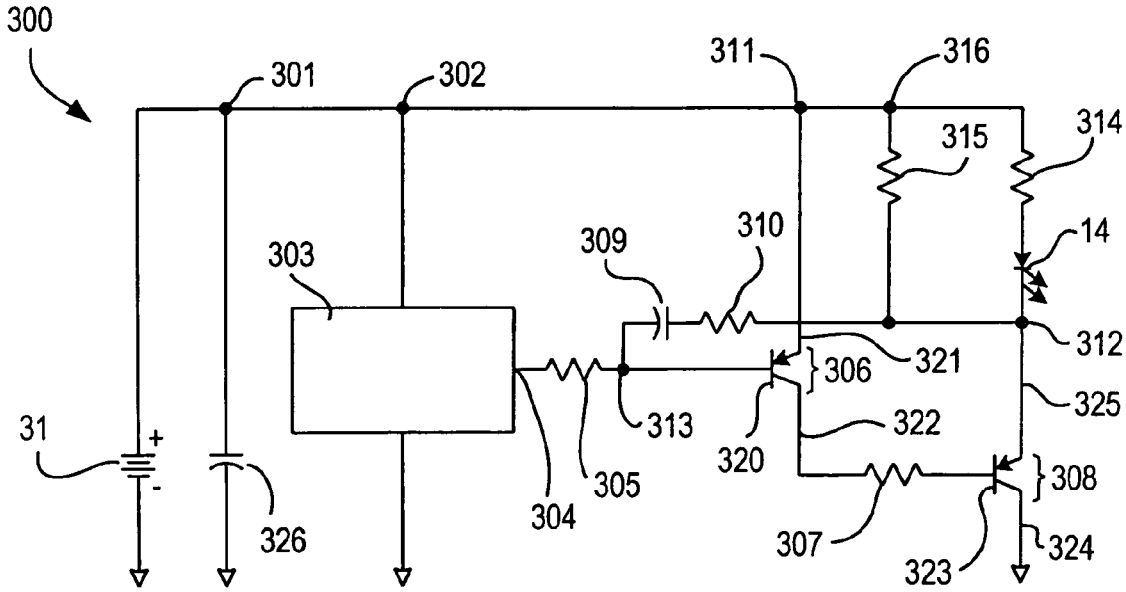
FIG. 9, is a circuit diagram of a circuit suitable for controlling an alert LED in accordance with an embodiment of the invention.

An embodiment of the alerting mechanism can comprise a circuit as depicted in FIG. 9, which shows a circuit diagram of an alerting mechanism comprising a flashing red low voltage indicating LED 14. According to this embodiment of the alerting mechanism, the red low voltage indicating LED 14 starts flashing when the battery reach a predetermined voltage, such as about 3.8V, and continues to flash as the voltage of the battery continues to decrease until either the battery is replaced or until the source of the battery drops to about 1.9V.

A preferred embodiment of the alert mechanism includes a circuit designed to activate the alert when the battery reaches 3.8V while in the standby mode. Once the device powered by a battery is activated, thereby initiating the use of the battery, the static voltage drops almost immediately. Therefore a battery at about 3.8V will drop to about 3.6V as soon as it is used, and if used with the invention, the battery will keep the LEDs lit for about twelve hours, which is significantly less than the capacity and the objectives of the invention.

The invention is preferably capable of over about sixty continuous hours of use with a 4.5V battery and over one hundred twenty hours of continuous use with a battery having a larger capacity, such as three alkaline D batteries.

If the invention is in use, the red alert does not signify that the battery must be changed. Rather, in use, the alert serves as an indicator that a certain amount of time remains before the battery is unable to keep the LEDs lit. For example, if the initial current drawn is about 122 mA, when the red alert begins to flash, it indicates that the LEDs will be lit for about an additional 24 hours. A battery having 3.8V while the LEDs are lit will not experience an initial static voltage drop. Therefore 3.8V are available to light the LEDs and will light the LEDs for an additional about 24 hours.

The alert LED of the alerting mechanism preferably draws a minimal amount of power and therefore has substantially no effect on the life of the battery. The embodiments of the alerting mechanisms shown in FIGS. 9 and 16 preferably draw around 2 μA.

FIG. 9 shows a preferred embodiment of a circuit driving an alerting mechanism with one red low voltage indicator LED 14. Battery power source 31 is connected between a point 301 and ground and is also connected in parallel with a capacitor 326, which is also grounded. Battery power source 31 is also connected in parallel at a point 302 with a voltage detector 303 which is also grounded. The output 304 of voltage detector 303 will be negative if the voltage is less than a predetermined threshold voltage, for example, 3.8 V, and the output 304 will be positive if the voltage is greater than the predetermined threshold voltage. The output voltage passes through a resistor 305, which is connected to the base 320 of an PNP transistor 306, which is part of an oscillating circuit together with a PNP transistor 308, which turns on and off red low voltage indicating LED 14 at a predetermined rate.

A resistor 307 is located between the collector 322 of PNP transistor 306 and the base 323 of PNP transistor 308. The emitter 324 of PNP transistor 308 is grounded. PNP transistor 306 is connected to battery power source 31 at point 311. A series connected resistor 310 and a capacitor 309 are connected between the base 320 of PNP transistor 306 and the emitter 325 of PNP transistor 308, and resistor 315 is also connected to battery power source 31 at point 316 and point 312. Resistors 310 and 315 and capacitor 309 constitute feedback circuit, which determines the rate at which red low voltage indicating LED 14 flashes. In a preferred embodiment of the alert mechanism, the rate at which red low voltage indicating LED 14 flashes is about 2 ms on and about 2 s off. A resistor 314 is connected in series with red low voltage indicating LED 14, between battery power source 31 and the emitter 325 of PNP transistor 308.

Figure 16:
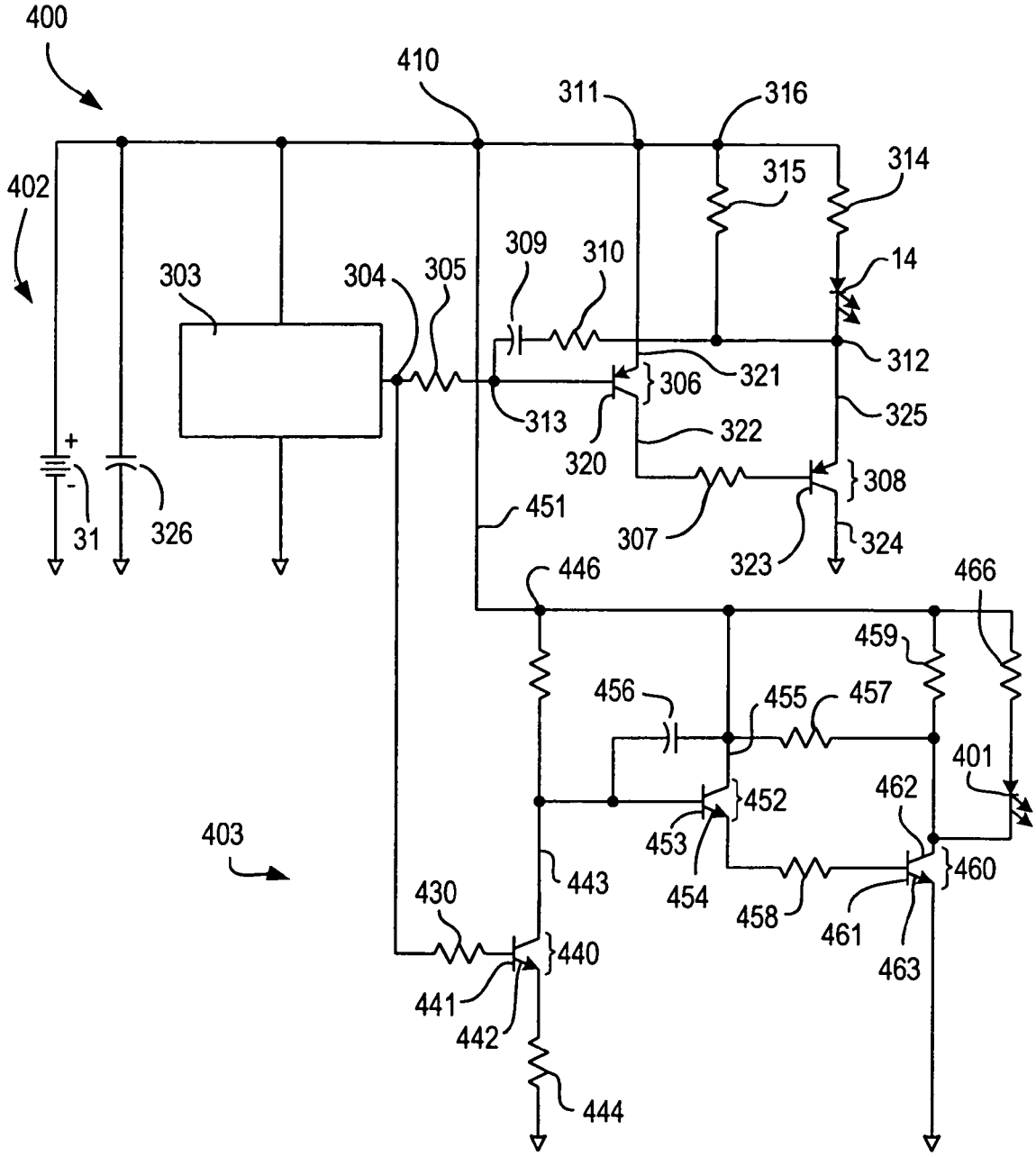
FIG. 16, is a circuit diagram of a circuit suitable for providing an alert in accordance with a second embodiment of the invention.

The low battery alerting mechanism can also include a high voltage indicator in addition to or in place of a low voltage indicator. An example of a circuit suitable for use with a low battery alerting mechanism having both a high voltage indicator LED 401 and a low voltage indicator LED 14 is shown in FIG. 16. According to this embodiment, a green high voltage indicator LED 401 flashes when the battery is above 3.8V. Once the voltage drops to 3.8V, the green high voltage indicator LED 401 shuts off and the red low voltage indicator LED starts flashing. Preferably both the green high voltage indicator LED 401 and the red low voltage indicator LED 14 will draw about 2 μA, thereby not affecting the life of the battery.

In the alert mechanism circuit 400 of FIG. 16, a red low voltage indicating LED 14 and a green high voltage indicator LED 401 are provided. Circuit 400 comprises a section 402, which is substantially circuit 300 of the alert mechanism comprising just a red low voltage indicating LED, as shown in FIG. 9 (like reference numbers being applied to like elements), and a section 403, which drives green high voltage indicator LED 401.

Section 403 is connected to section 402 at points 410 and 304, which connect section 403 to batteries 31 and the output section 304 of voltage detector 303, respectively.

The voltages of output section 304 is applied through resistor 430 to base 441 of a NPN transistor 440, an emitter 442 of which is connected to a resistor 444 which is grounded. Collector 443 of NPN transistor 440 is connected through a resistor 445 to point 446, which is connected to batteries 31 and to the base 453 of an PNP transistor 452. A feedback circuit consisting of series—connected capacitor 456 and resistor 457, which, together with resistor 459, connected between point 446 and collector 462 of NPN transistor 460, controls the rate at which the green high voltage indicator LED 401 flashes, is connected between base 453 of PNP transistor 452, and the collector 462 of NPN transistor 460. The emittor—collector path (455, 463) of PNP transistor 452 is connected between point 446 and a resistor 458, which is, in turn, connected to base 461 of NPN transistor 460 which has an emitter 463 that is grounded. The green high voltage indicator LED 401 and a resistor 466 are connected in series between point 446 and collector 462 of NPN transistor 460.

FIGS. 10–15 show an alternate embodiment of the invention having a housing comprising an upper portion 161 and a lower portion 162, that is generally shaped like a rectangular box, three LEDs comprised of LED assemblies 112, 113 designed to produce beams and one LED 111, producing distributed light, a mounting bracket 120 connected to housing 110 via knobs 122, and a manual switch 119. Housing 110 preferably comprises of a bottom wall 151 and a top wall 152 and four side walls 153, 154, 155 and 156 enclosing three batteries 131. Batteries 131 are further secured by holders 133, 134 which carry contacts 135, 131. Switch 119 is positioned on side wall 155 and is secured by a nut 135. Mounting bracket 121 includes two holes through which screws 137 can be inserted to attach the mounting bracket to the desired area and position, such as a fixture, wall or ceiling. Mounting bracket 121 preferably includes slots 121 through which knobs 122 can be inserted and removed, thereby facilitating the mounting and dismounting of the invention. Knobs 122 are each releasably attached to housing 110 via a threaded portion 123 that engages with a nut 13 each received in slots in slots in of housing 110. A resilient material such as sponge 139 is mounted inside housing 110 to help hold the parts in place.

Figure 10:
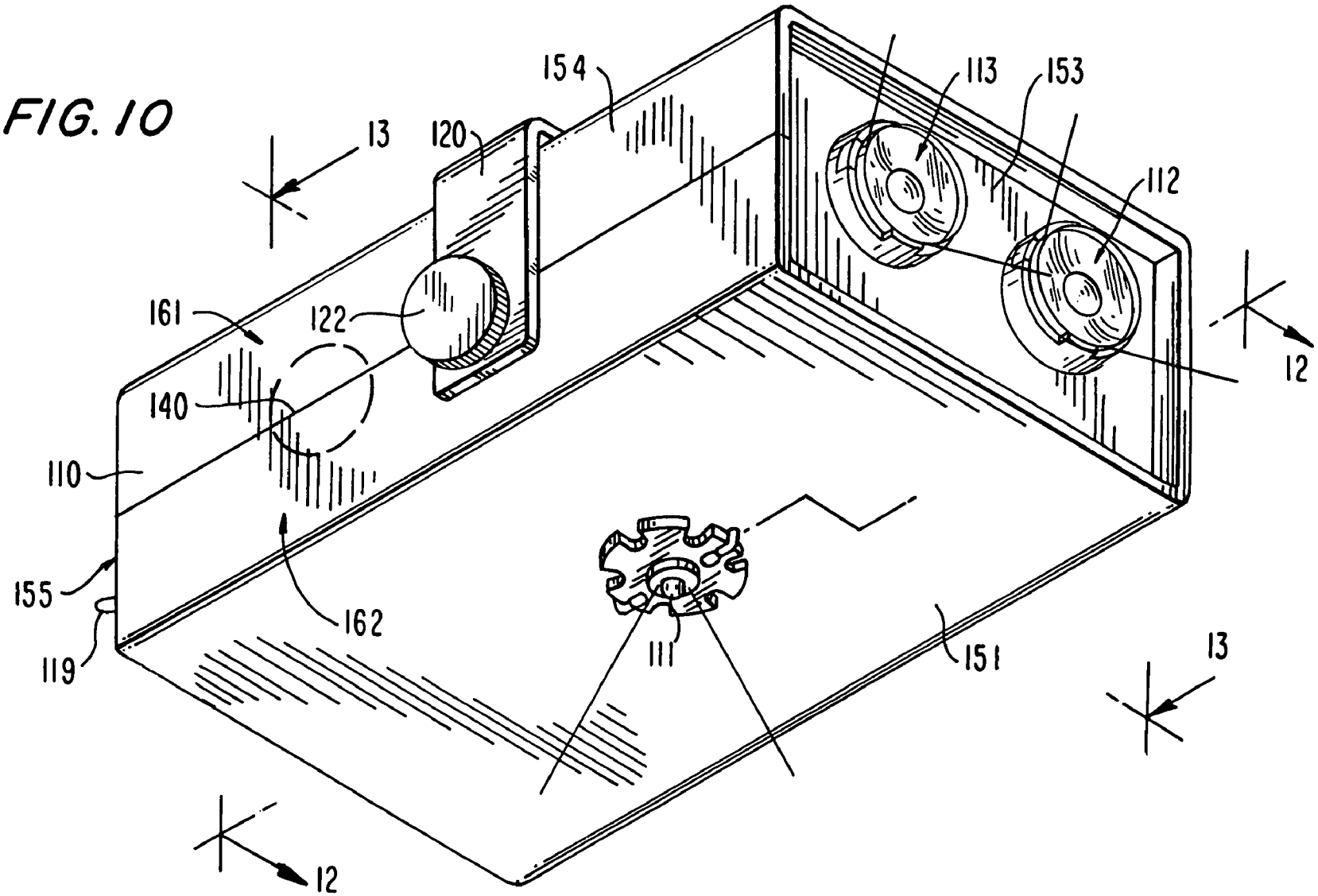
FIG. 10 is a perspective view of a second embodiment of a light source constructed in accordance with an embodiment of the invention.
Figure 11:
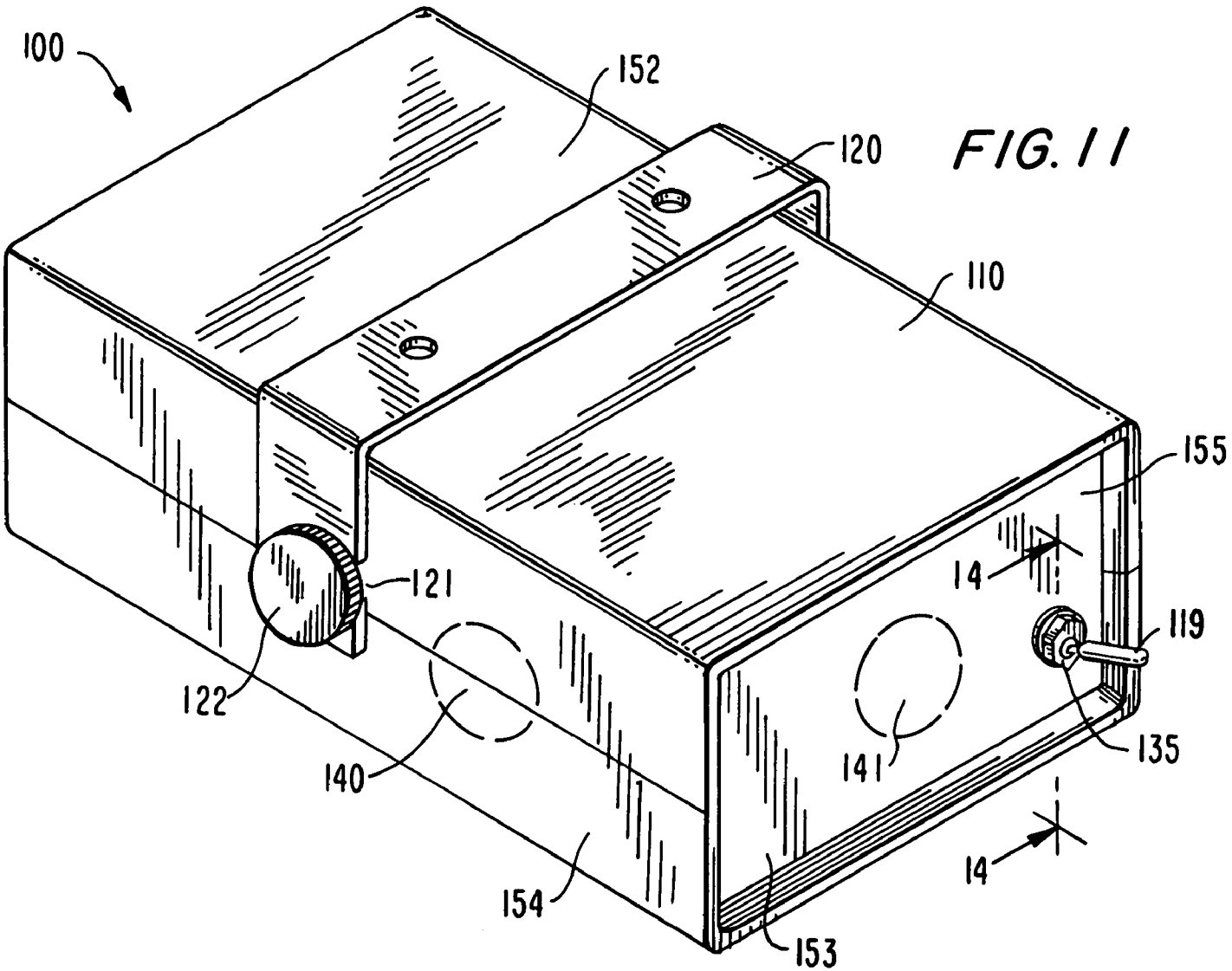
FIG. 11 is a reverse perspective view of the light source of FIG. 10.
Figure 12:
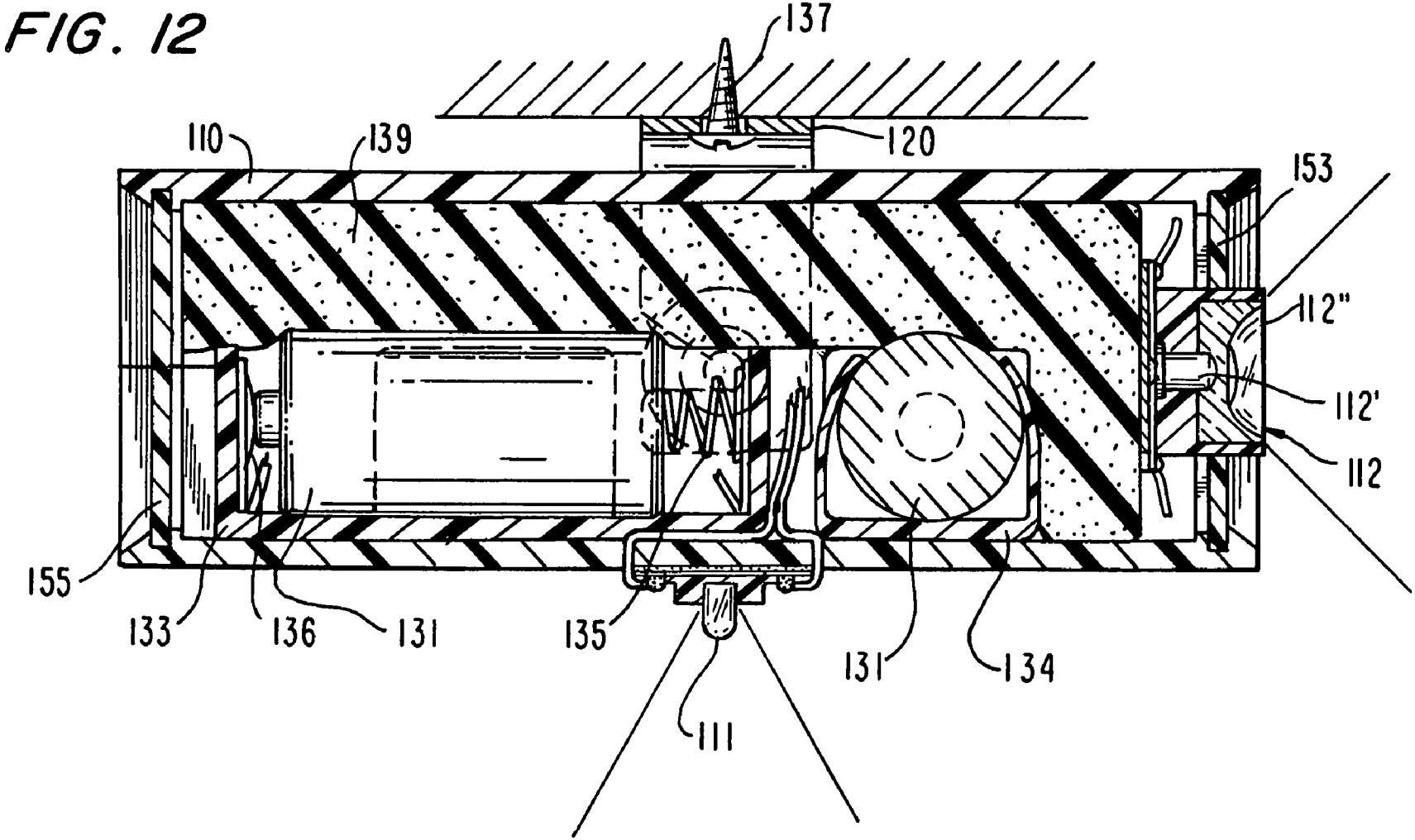
FIG. 12 is a cross-sectional view of the light source of FIG. 10, taken along section line 12—12 of FIG. 10.
Figure 13:
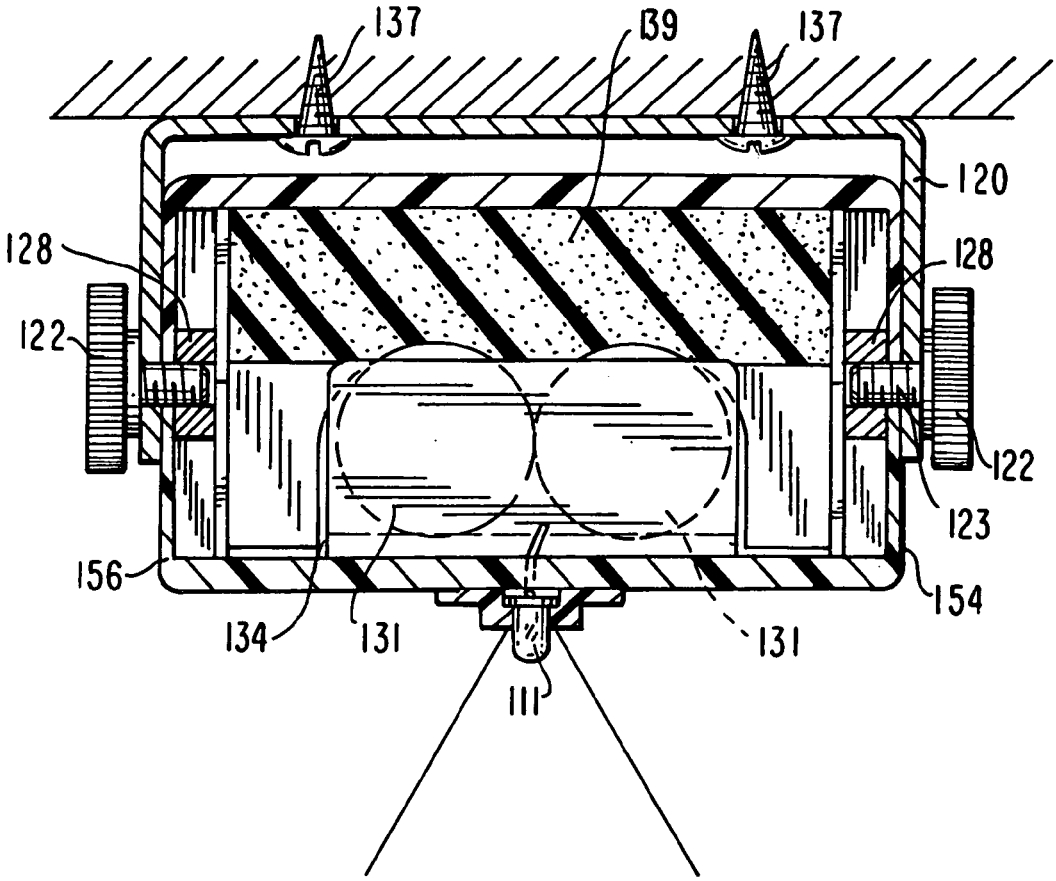
FIG. 13 is a cross-sectional view of the light source of FIG. 10, taken along section line 13—13 of FIG. 10.
Figure 14:
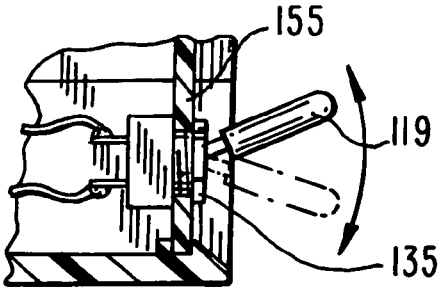
FIG. 14 is a cross-sectional view of a part of the light source of FIG. 10 taken along section line 14—14 of FIG. 11.
Figure 15:
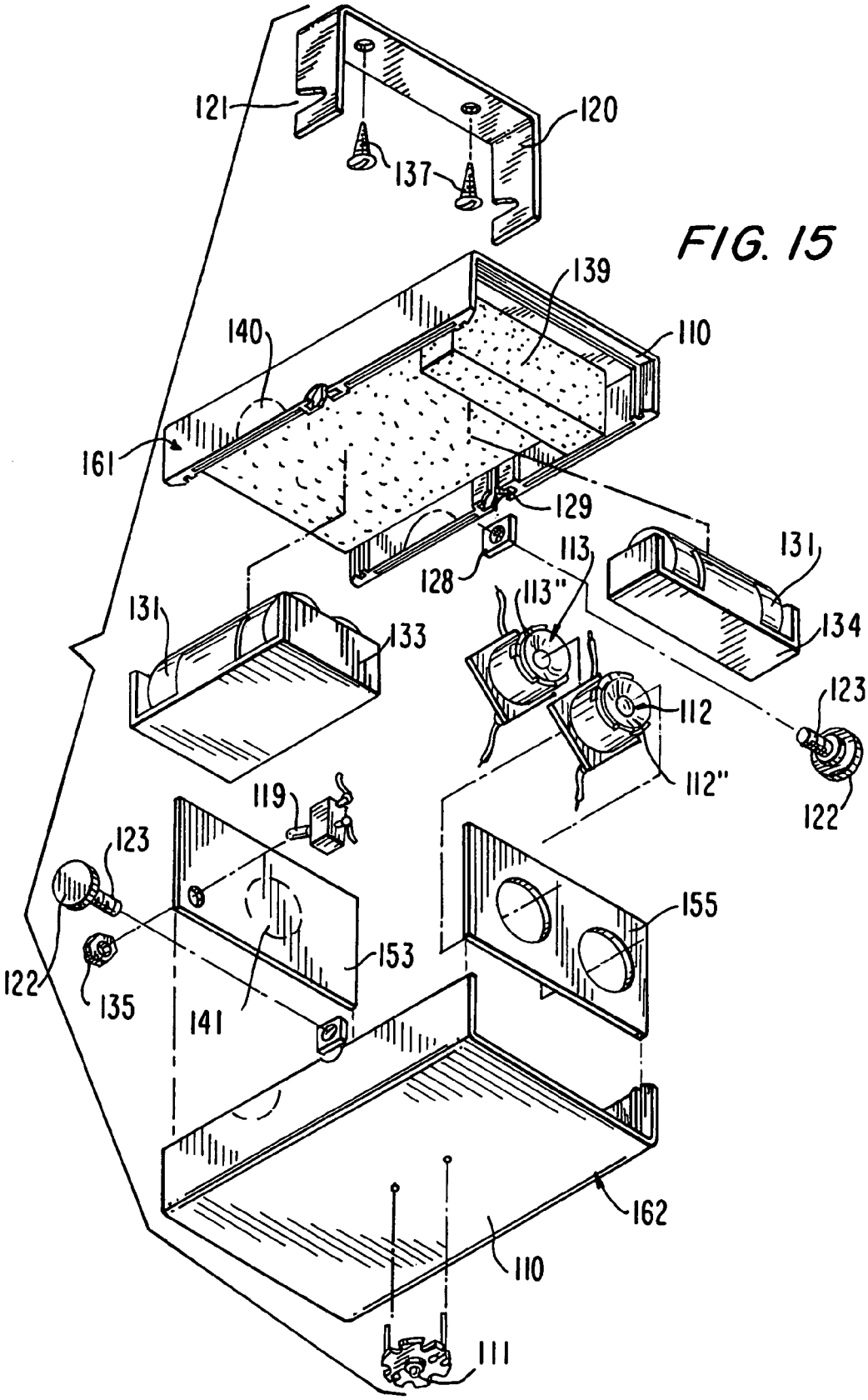
FIG. 15 is an exploded view of the light source of FIG. 10.

LED assemblies 112, 113 consist of an LED 112', 113' and a collimating lens 112," 113." As shown in FIG. 10, LED assemblies 112, 113 are placed adjacent to each other on side wall 153 of housing 110, and LED 111 is placed on bottom wall 151. Knock-out portions 140 and 141 define openings in side walls 154 and 155 respectively, in which LED assemblies 112 or 113 can be placed as alternate positions. For example, if LED assembly 112 is placed in the opening defined by knock-out portion 140, the invention will illuminate two separate areas at right angles to each other in addition to the vicinity of the invention illuminated by LED assembly 111. Such an arrangement can be placed at a corner to light two separate hallways extending from the corner. Alternatively, LED assembly 112 can be placed in the opening defined by knock-out portion 141, shown in FIG. 11, which is at a 180° angle from LED assembly 113. A possible use for this arrangement is in a long hallway, where two separate beams shooting beams of light in opposite directions is desirable. It is understood that the invention is not limited to a rectangular housing but that the housing can be any shape as a matter of application specific to design choice, and LED assemblies 112, 113 can be positioned at various angles not limited to right angle increments.

In the embodiment of the invention depicted in FIGS. 10–15, emergency light source 100 is powered by three Alkaline C batteries 131, which provide a total voltage of about 4.5V. Emergency light source 100 preferably includes a circuit designed to draw a small amount of energy from power source 131, substantially equal to the energy necessary to activate LEDs 111, 112, 113, thereby maximizing the utility of the batteries. The embodiment of the invention using three alkaline C batteries can provide over 48 hours of continuous use, more preferably about 54 to 62 hours, which is substantially longer than the lifetime of any conventional battery operated emergency light source. However, the invention is not limited to any particular number or type of battery provided it provides sufficient power over a sufficient period of time to cause the LEDs to emit a sufficient amount of light to perform its emergency lighting function for a desired period of time.

While there have been shown and described and pointed out novel features of the present invention as applied to preferred embodiments thereof, it will be understood that various omissions and substitutions and changes in the form and details of the disclosed invention may be made by those skilled in the art without departing from the spirit of the invention. For example, a different battery, such as alkaline D batteries, can be used to power the invention. If three alkaline D batteries are used, the invention can provide over about 100 hours of continuous lighting. Whereas the embodiments described show three LEDs, it is understood that more or less LEDs may be used without deviating from the novel characteristics of the invention. Furthermore, whereas one LED will provide sufficient light in accordance with the invention, it is preferable to include at least 2 LEDs. Additionally, the brightness of the LEDs can be adjusted by varying the resistors in the circuit, wherein a brighter light will result in a shorter duration of illumination. The housing can also take a variety of shapes and sizes, and the distributed light and beams can be positioned at different angles than described with regard to the preferred embodiments, as a matter of application specific to design choice. It is the intention, therefore, to be limited only as indicated by the scope of the claims appended hereto.

It is also to be understood that the following claims are intended to cover all of the generic and specific features of the invention herein described and all statements of the scope of the invention which, as a matter of language, might be said to fall there between. In particular, this invention should not be construed as being limited to the dimensions, proportions or arrangements disclosed herein.

What is claimed is:

1. An emergency light source comprising:

a housing;

at least one LED carried by said housing and performing an emergency lighting function in a selected area when energized;

a battery power source carried by said housing selected to energize said at least one LED to provide at least twenty-four hours of continuous light;

an energizing circuit carried by said housing selectively operatively coupling said at least one LED with said battery power source to energize said at least one LED; and an activator carried by said housing and comprising at least one of a manual activator and at least one light detector detecting a predetermined reduction in ambient light, said activator being operatively coupled to said energizing circuit to cause said energizing circuit to operatively couple said battery power source and said at least one LED;

wherein the energizing circuit draws a current that gradually decreases with time while operatively coupling said battery power source and said at least one LED.

2. The emergency light source claimed in claim 1, wherein said battery power source is one or more alkaline batteries.

3. The emergency light source claimed in claim 1, wherein said battery power source is rated at about 4.5V.

4. The emergency light source claimed in claim 1, wherein said at least one LED and said battery power source are selected to permit the said at least one LED to provide at least 60 hours of continuous light.

5. The emergency light source claimed in claim 1, wherein said light detector comprises one or more CdS variable resistors.

6. The emergency light source claimed in claim 1, further comprising a mounting mechanism supporting said housing in said selected area.

7. The emergency light source claimed in claim 6, wherein said housing is detachably coupled to said mounting mechanism.

8. The emergency light source claimed in claim 1, further comprising a power level indicating mechanism.

9. The emergency light source claimed in claim 8, wherein the power level indicating mechanism comprises an LED which indicates a battery voltage of about 3.8V or less.

10. The emergency light source claimed in claim 8, wherein the power indicating mechanism comprises an LED which indicates a battery voltage of greater than about 3.8V.

11. The emergency light source claimed in claim 10, wherein the power indicating mechanism further comprises an LED which indicates a battery voltage of about 3.8V or less.

12. The emergency light source claimed in claim 8, wherein the power indicating mechanism draws less than about 2 μA.

13. The emergency light source claimed in claim 1, wherein the emergency light source draws less than about 22 μA on standby.

14. The emergency light source claimed in claim 1, wherein the energizing circuit draws an initial current of 122 mA when initially operatively coupling said battery power source and said at least one LED.

15. The emergency light source claimed in claim 1, wherein at least one LED provides distributed light.

16. The emergency light source claimed in claim 1, wherein at least one LED provides a beam of light.

17. The energizing light source claimed in claim 16, and including a lens member for converting distributed light from the LED to at least one beam of light.

18. The emergency light source claimed in claim 16, wherein the beam of light illuminates at least thirty feet from the housing.

19. The emergency light source claimed in claim 1, wherein said activator comprises at least one light detector mounted on the same side of said housing as at least said one LED, said activator further comprising a shield member between said at least one LED and said light detector preventing activation of said light detector by light from said at least one LED.

20. The emergency light source claimed in claim 1, wherein at least one LED is positioned on a bottom surface of said housing and provides distributed light and at least a second LED is positioned on a side surface of the housing and provides a beam of light.

21. The emergency light source claimed in claim 1, wherein said housing is provided with at least one opening and/or a knock-out portion defining an opening on each of at two sides of said housing facing in different directions for releasably receiving said at least one LED to permit selective positioning of said at least one LED in one of said openings.

22. The emergency light source claimed in claim 21, wherein at least one LED providing a beam of light is positionable in each of two of said openings so as to face in different directions.

* * * * *